US008894168B2

(12) United States Patent
Lee

(10) Patent No.: US 8,894,168 B2
(45) Date of Patent: Nov. 25, 2014

(54) REFRIGERATOR HAVING GAP ADJUSTER

(75) Inventor: Jin Sik Lee, Gwangju-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 204 days.

(21) Appl. No.: 13/067,898

(22) Filed: Jul. 5, 2011

(65) Prior Publication Data

US 2012/0032572 A1 Feb. 9, 2012

(30) Foreign Application Priority Data

Aug. 6, 2010 (KR) ..... 10-2010-0075947

(51) Int. Cl.

| | |
|---|---|
| ***A47B 96/04*** | (2006.01) |
| ***E05F 5/06*** | (2006.01) |
| ***E05D 7/04*** | (2006.01) |
| ***F25D 23/02*** | (2006.01) |
| ***E05F 5/02*** | (2006.01) |

(52) U.S. Cl.

CPC ..... *F25D 23/028* (2013.01); *E05F 5/06* (2013.01); *E05Y 2600/63* (2013.01); *E05Y 2600/626* (2013.01); *E05Y 2600/502* (2013.01); *E05D 7/0423* (2013.01); *E05Y 2600/10* (2013.01); *E05F 5/02* (2013.01); *E05Y 2900/31* (2013.01); *E05Y 2600/12* (2013.01); *F25D 2400/06* (2013.01)

USPC ..... 312/405; 16/86 A

(58) Field of Classification Search

CPC ... F25D 23/02; F25D 23/028; E05Y 2900/31; E05Y 2900/531; E05F 5/02; E05F 5/06

USPC ..... 312/324–329, 405, 402, 404; 16/82, 83, 16/85, 86 R, 86 A

See application file for complete search history.

(56) References Cited

U.S. PATENT DOCUMENTS

| | | | | |
|---|---|---|---|---|
| 2,441,221 | A | | 5/1948 | Eckel |
| 2,827,863 | A | | 3/1958 | Ritzenberg |
| 3,026,825 | A | | 3/1962 | Kidwell |
| 3,290,109 | A | | 12/1966 | Vanegas |
| 3,442,563 | A | * | 5/1969 | Scroop ..... 312/405 |
| 4,033,044 | A | * | 7/1977 | Michaels ..... 33/667 |
| 4,132,440 | A | * | 1/1979 | Johnson ..... 292/341.19 |
| 4,186,476 | A | * | 2/1980 | Mair et al. ..... 29/407.1 |
| 4,411,419 | A | * | 10/1983 | Silverman et al. ..... 271/263 |
| 4,601,502 | A | * | 7/1986 | Van Dyke ..... 292/252 |
| 4,696,500 | A | * | 9/1987 | Zunkel ..... 292/251.5 |

(Continued)

FOREIGN PATENT DOCUMENTS

FR 795 695 3/1936

OTHER PUBLICATIONS

Extended European Search Report issued Sep. 5, 2013 in corresponding European Patent Application No. 11 17 4077.

(Continued)

*Primary Examiner* — Hanh V Tran
(74) *Attorney, Agent, or Firm* — Staas & Halsey LLP

(57) ABSTRACT

A refrigerator having a gap adjuster includes a main body, at least one door to open and close the main body, and the gap adjuster located between the main body and the at least one door such that a length of the gap adjuster is increased or decreased so as to adjust a gap between the main body and the at least one door.

8 Claims, 14 Drawing Sheets

(56) References Cited

U.S. PATENT DOCUMENTS

| | | | | |
|---|---|---|---|---|
| 5,064,255 | A * | 11/1991 | Inui et al. | 312/405 |
| 5,069,512 | A * | 12/1991 | Sykes | 312/139.2 |
| 6,141,829 | A * | 11/2000 | Boyer | 16/224 |
| 6,338,536 | B1 * | 1/2002 | Ueno et al. | 312/405 |
| 6,615,450 | B2 * | 9/2003 | Salice | 16/85 |
| 6,845,545 | B2 * | 1/2005 | Han et al. | 16/277 |
| 7,104,621 | B2 * | 9/2006 | Choi | 312/296 |
| 7,231,124 | B2 * | 6/2007 | Weinert | 385/134 |
| 7,429,091 | B2 * | 9/2008 | Reed et al. | 312/408 |
| 8,382,219 | B2 * | 2/2013 | Hottmann et al. | 312/405 |
| 8,388,074 | B1 * | 3/2013 | Donberger et al. | 312/204 |
| 8,444,237 | B2 * | 5/2013 | Kang et al. | 312/405 |
| 2008/0034539 | A1 | 2/2008 | Lyvers et al. | |
| 2008/0168793 | A1 * | 7/2008 | Hottmann | 62/441 |
| 2008/0244862 | A1 * | 10/2008 | Tooyama | 16/82 |
| 2008/0265729 | A1 * | 10/2008 | Netzer et al. | 312/330.1 |
| 2008/0278049 | A1 * | 11/2008 | Park et al. | 312/405 |
| 2010/0033067 | A1 * | 2/2010 | Kim et al. | 312/236 |
| 2010/0219648 | A1 * | 9/2010 | Watson | 292/343 |
| 2011/0119865 | A1 * | 5/2011 | Vigeh et al. | 16/82 |
| 2012/0146470 | A1 * | 6/2012 | Katz et al. | 312/225 |

OTHER PUBLICATIONS

European Office Action issued Jun. 23, 2014 in corresponding European Application No. 11 174 077.5.

* cited by examiner

REFRIGERATOR HAVING GAP ADJUSTER

CROSS-REFERENCE TO RELATED APPLICATIONS

This application claims the benefit of Korean Patent Application No. 2010-0075947, filed on Aug. 6, 2010 in the Korean Intellectual Property Office, the disclosure of which is incorporated herein by reference.

BACKGROUND

1. Field

Embodiments of the present disclosure relate to a refrigerator in which a step difference between doors is controlled by adjusting gaps between the doors and a main body.

2. Description of the Related Art

In general, a refrigerator is an apparatus which stores articles in a fresh state for a long time using cool air supplied to the insides of storage chambers. The cool air supplied to the insides of the storage chambers is generated through heat interchange with a refrigerant. The cool air supplied to the insides of the storage chambers is uniformly transferred to the inside of the storage chambers so as to store food at a desired temperature.

The refrigerator includes storage chambers provided within a main body forming the external appearance of the refrigerator such that the front surfaces of the storage chambers are opened so as to receive food. Doors to open and close the storage chambers are installed on the front surfaces of the storage chambers. The doors are hinged to the main body and are rotated to open and close the storage chambers.

The refrigerator includes a plurality of storage chambers according to storage manners of food. The refrigerator generally includes a refrigerating chamber and a freezing chamber within the main body. Further, in order to respectively open and close the refrigerating chamber and the freezing chamber, a refrigerating chamber door and a freezing chamber door are provided.

There is a designated gap between the main body and the door of the refrigerator. When a gap between the refrigerating chamber door and the main body and a gap between the freezing chamber door and the main body are different, a step difference between the refrigerating chamber door and the freezing chamber door may occur.

SUMMARY

Therefore, it is an aspect of the present disclosure to provide a refrigerator having a gap adjuster.

Additional aspects of the disclosure will be set forth in part in the description which follows and, in part, will be obvious from the description, or may be learned by practice of the disclosure.

In accordance with one aspect of the present disclosure, a refrigerator includes a main body, at least one door to open and close the main body, and a gap adjuster located between the main body and the at least one door such that a length of the gap adjuster is increased or decreased so as to adjust a gap between the main body and the at least one door.

The gap adjuster may be fixed to the at least one door and contact the main body in a closed state of the at least one door.

The gap adjuster may include a fixing unit fixed to the at least one door and an adjusting unit movable in a forward and backward direction of the at least one door under the condition that the adjusting unit is connected to the fixing unit.

The fixing unit may include a fixing nut mounted on the at least one door, and the adjusting unit may include an adjusting bolt rotatably connected to the fixing nut.

The fixing unit may include a fixing hole formed on the at least one door and provided with a screw thread, and the adjusting unit may include an adjusting bolt rotatably connected to the fixing hole.

The fixing unit may include a protrusion protruded from the at least one door and including a receipt hole provided with a screw thread, and the adjusting unit may include an adjusting bolt rotatably connected to the receipt hole.

The fixing unit may include a protrusion protruded from the at least one door and provided with a screw thread on the external surface thereof, and the adjusting unit may include an adjusting nut rotatably connected to the protrusion.

The fixing unit may include a fixing bolt mounted on the at least one door, and the adjusting unit may include an adjusting nut rotatably connected to the fixing bolt.

The gap adjuster may further include a buffer unit disposed between the adjusting unit and the main body to damp impact applied to the main body by the adjusting unit.

The buffer unit may be made of an elastic material and be connected to the adjusting unit.

The gap adjuster may further include a position fixing unit to fix a position of the adjusting unit.

The gap adjuster may be fixed to the main body and contact the at least one door in a closed state of the at least one door.

In accordance with another aspect of the present disclosure, a refrigerator includes a main body provided with a first storage chamber and a second storage chamber, a first door connected to the main body so as to open and close the first storage chamber, a second door connected to the main body so as to open and close the second storage chamber, and a gap adjuster located within a space between the first door and the main body such that a length of the gap adjuster is increased or decreased, wherein the gap adjuster adjusts a gap between the main body and the first door so as to adjust a step difference in a forward and backward direction between the first door and the second door.

The gap adjuster may be fixed to the first door and contact the upper end of the front surface of the main body in a closed state of the first door.

The gap adjuster may include a fixing unit fixed to the first door and an adjusting unit movable in the forward and backward direction of the first door under the condition that the adjusting unit is connected to the fixing unit.

The fixing unit may include a fixing nut mounted on the first door, and the adjusting unit may include an adjusting bolt rotatably connected to the fixing nut.

The fixing nut may be fixed to the first door through thermocompression.

The gap adjuster may further include a position fixing unit to fix a position of the adjusting unit, the position fixing unit may include a locking nut connected to the fixing bolt, and the locking nut may be closely adhered to the fixing nut so as to prevent arbitrary movement of the adjusting bolt in a direction of the fixing nut.

The refrigerator may further include a hinge device to hinge the at least one door to the main body, and the hinge device may include a hinge unit connected to the at least one door, a loading unit fixed to the main body to receive the hinge unit, and an adjusting unit connected to the hinge unit to move the hinge unit so as to adjust the gap between the main body and the at least one door.

The adjusting unit may include a first adjusting screw to move the hinge unit in a first direction.

The loading unit may include a first fixing part bent upward from the edge of one side of the loading unit, and the hinge unit may include a first bent part formed at a position corresponding to the first fixing part.

The first bent part may include a first connection part connected to the first adjusting screw, and the first adjusting screw may include a head part, a fixing washer part formed at a position extended inward from the head part, and a fixing gap part formed between the head part and the fixing washer part so as to be connected to the first connection part.

The first adjusting screw may couple the first bent part to the first fixing part, and when the first adjusting screw is rotated, the hinge unit may move in the first direction and the at least one door may move in the first direction by means of the hinge unit.

The hinge device may further include a fixing unit connected to the loading unit so as to closely adhere the hinge unit to the main body.

The fixing unit may include a connection shaft rotatably connected to the loading unit, a pressure part to press the hinge unit according to rotation of the connection shaft so as to fix the hinge unit, and a handle part extended from the pressure part in the longitudinal direction.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
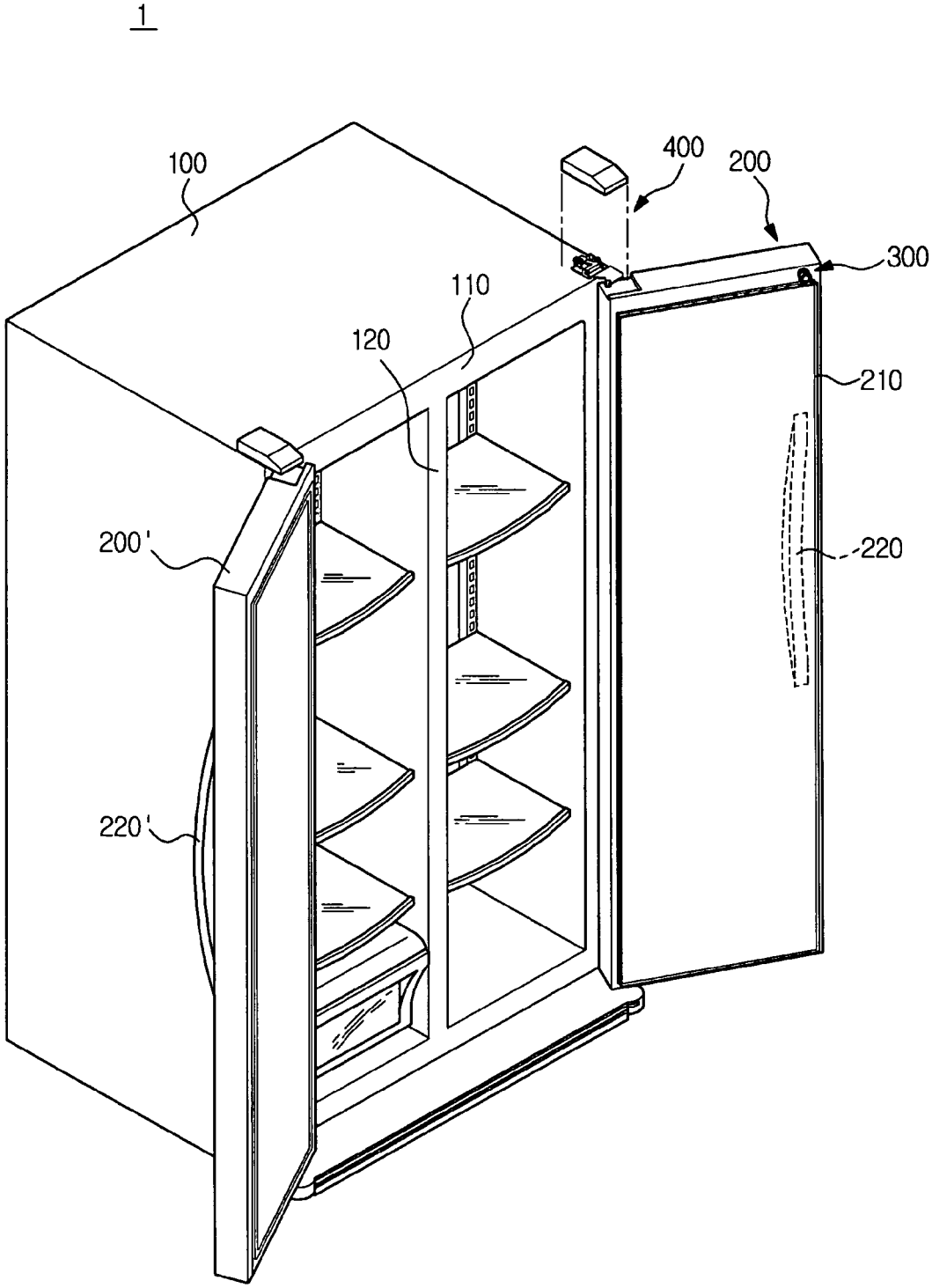
FIG. 1 is a perspective view illustrating a main configuration of a refrigerator in accordance with one embodiment of the present disclosure.

Reference will now be made in detail to the embodiments of the present disclosure, examples of which are illustrated in the accompanying drawings, wherein like reference numerals refer to like elements throughout.

FIG. 1 is a perspective view illustrating a main configuration of a refrigerator in accordance with one embodiment of the present disclosure.

As shown in FIG. 1, a refrigerator 1 in accordance with this embodiment includes a main body 100 forming the external appearance of the refrigerator 1, a first storage chamber and a second storage chamber provided within the main body 100, and a first door 200 and a second door 200' to respectively open and close the first storage chamber and the second storage chamber.

The first storage chamber and the second storage chamber may be a freezing chamber which stores food in a frozen state and a refrigerating chamber which stores food in a refrigerated state.

The first door 200 and the second door 200' are respectively rotated with respect to the main body 100, thus selectively opening and closing the first storage chamber and the second storage chamber. The first door 200 is opened to the right and the second door 200' is opened to the left. Further, in order to rotate the doors 200 and 200' with respect to the main body 100, a hinge device 400 is connected to at least one of the upper end and the lower end of each of the doors 200 and 200'.

Further, handles 220 and 220' gripped by a user in order to open and close doors 200 and 200' are provided on the left portion of the front surface of the first door 200 and the right portion of the front surface of the second door 200'.

A gasket 210 made of an elastic material is disposed on the rear surface of each of the doors 200 and 200'. The gasket 210 is mounted on the rear surface of each of the doors 200 and 200' so as to form a border at a position separated inward from the outer circumference of the rear surface of each of the doors 200 and 200' by a designated interval. A magnetic member (not shown) is disposed within the gasket 210, and thus each of the doors 200 and 200' is closely adhered to the main body 100 using magnetic force. Therefore, the doors 200 and 200' shield the storage chambers under the condition that the doors 200 and 200' are separated from the main body 100 by designated gaps.

The gasket 210 is made of an elastic material and has a designated clearance. The doors 200 and 200' may be deformed during manufacture or installation of the doors 200 and 200'. Therefore, the gap between the first door 200 and the main body 100 and the gap between the second door 200' and the main body 100 may be different.

Accordingly, the refrigerator 1 includes a gap adjuster 300 to adjust the gap between the door 200 or 200' and the main body 100.

Figure 2:
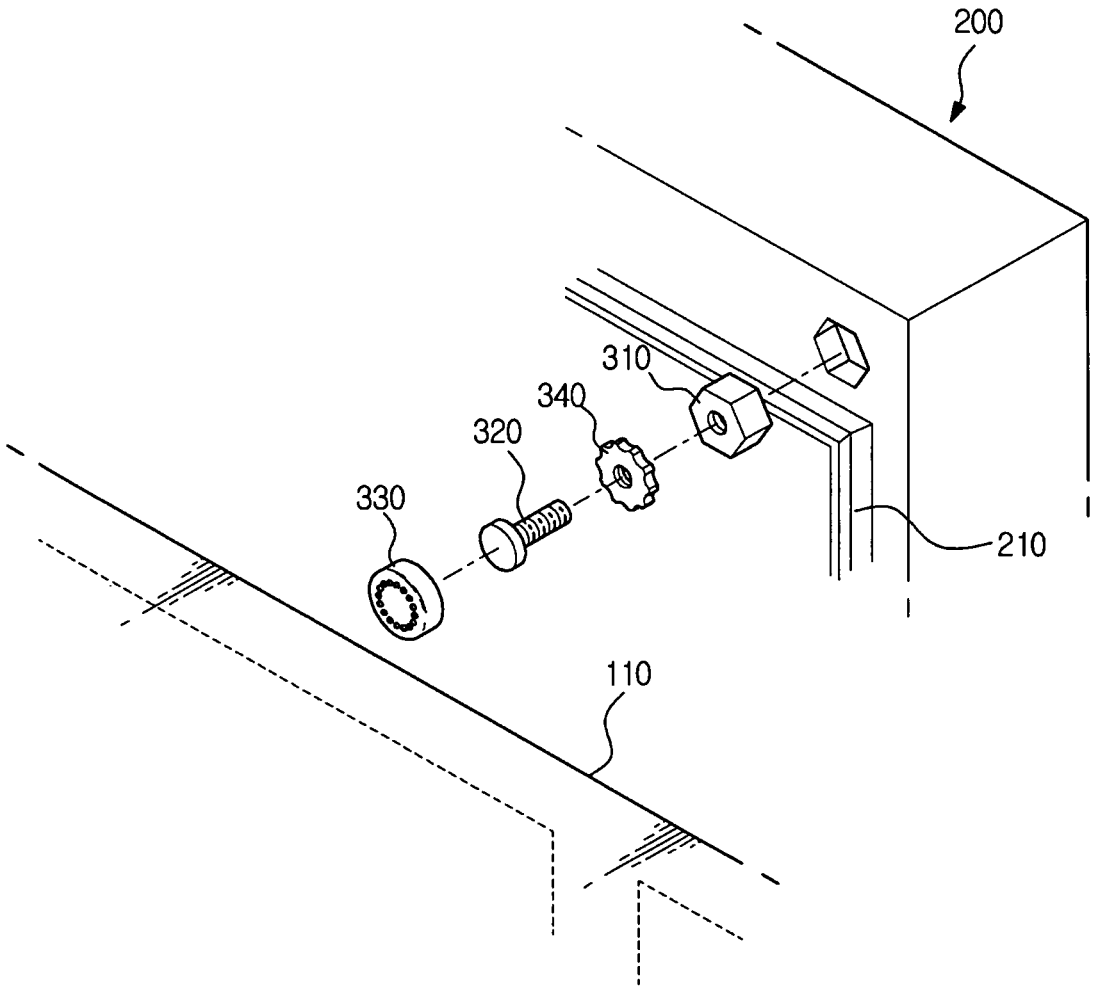
FIG. 2 is an exploded perspective view illustrating a gap adjuster of the refrigerator in accordance with the embodiment of the present disclosure.
Figure 3A:
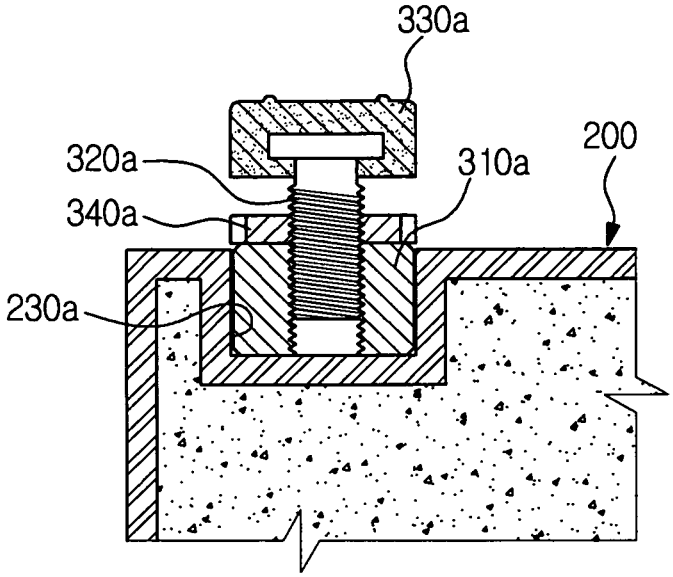
FIG. 3A is a cross-sectional view of the gap adjuster in accordance with one embodiment of the present disclosure.

FIG. 2 is an exploded perspective view illustrating the gap adjuster of the refrigerator in accordance with the embodiment of the present disclosure and FIG. 3A is a cross-sectional view of a gap adjuster in accordance with one embodiment of the present disclosure.

As shown in FIG. 2, the gap adjuster 300 includes a fixing unit 310, an adjusting unit 320 connected to the fixing unit 310, a buffer unit 330 connected to the adjusting unit 320, and a position fixing unit 340 to fix the adjusting unit 320 to the fixing unit 310.

The gap adjuster 300 may be mounted on at least one of the first door 200 and the second door 200'. Hereinafter, the gap adjuster 300 mounted on the first door 200 will be described.

The gap adjuster 300, is fixed to the rear surface of the first door 200 and contacts the main body 100 in a closed state of the first door 200. Therefore, the gap adjuster 300 is rotated together with the first door 200 and contacts the main body 100 when the first door 20 is closed. As a length of the gap adjuster 300 is increased or decreased in forward backward direction of the first door 200, the gap between the first door 200 and the main body 100 in the closed state of the first door 200 is increased or decreased.

The gap adjuster 300 may be mounted at the outside of the gasket 210 mounted on the rear surface of the first door 200. Therefore, the gap adjuster 300 is not exposed to cool air in the closed state of the first door 200.

The gap adjuster 300 is disposed so as to contact an upper wall 110 of the main body 100. Further, the gap adjuster 300 may be mounted on the first door 200 so as to contact a diaphragm wall 120 dividing the first storage chamber and the second storage chamber shown in FIG. 1 from each other.

As shown in FIGS. 2 and 3A, the fixing unit 310 fixes the gap adjuster 300 to the first door 200. The fixing unit 310 may be a fixing nut 310*a*. The fixing nut 310*a* is fixed to a connection hole 230*a* having a shape corresponding to the fixing nut 310*a* and formed on the rear surface of the first door 200. In order to restrict movement of the fixing nut 310*a* mounted in the connection hole 230*a*, the fixing nut 310*a* may be connected to the connection hole 230*a* in an interference fit fashion. Further, the entirety of the fixing nut 310*a* may be received in the connection hole 230*a*, or a part of the fixing nut 310*a* may be protruded from the rear surface of the first door 200.

Further, the connection hole 230*a* may be formed by connecting the fixing nut 310*a* to the rear surface of the first door 200 through thermocompression. Here, the rear surface of the first door 200 may be made of a polymer which is deformable by heat and pressure.

The fixing nut 310*a* may be made of a metal or may be an injection molded product made of a polymer. If the fixing nut 310*a* is made of a polymer, the fixing nut 410*a* may not be deformed when the fixing nut 310*a* is mounted on the rear surface of the first door 200 through thermocompression. Therefore, a temperature at which the fixing nut 310*a* starts to be deformed may be higher than a temperature at which thermocompression is carried out.

The adjusting unit 320 is movably connected to the fixing unit 310. As the adjusting unit 320 moves toward the fixing unit 310, the length of the gap adjuster 300 is increased or decreased.

The adjusting unit 320 may be an adjusting bolt 320*a* screw-connected to the fixing nut 310*a*. The adjusting bolt 320*a* is turned along a screw thread of the fixing nut 310*a*, thus moving forward and backward. One end of the adjusting bolt 320*a* contacts the main body 100 in the closed state of the first door 200. Therefore, the gap between the first door 200 and the main body 100 may be determined by a length of a portion of the adjusting bolt 320*a* protruded to the outside of the fixing nut 310*a*.

A groove (not shown) to turn the adjusting bolt 320*a* with a tool, such as a driver, may be formed on one end of the adjusting bolt 320*a*. The adjusting bolt 320*a* may be made of a metal, or be an injection molded product made of a polymer.

The buffer unit 330 is disposed between the adjusting unit 320 and the main body 100, and absorbs physical impact applied to the main body 100 due to contact between the adjusting unit 320 and the main body 100 when the first door 200 is closed. When the first door 200 is repeatedly opened and closed, damage to a region of the main body 100 contacting the adjusting unit 320, such as peeling off of, a coating material from the region of the main body 100, may occur. Therefore, the buffer unit 330 provided between the adjusting unit 320 and the main body 100 serves to protect the main body 100.

The buffer unit 330 may be made of an elastic material. In general, the buffer unit 330 is made of rubber which effectively absorbs impact.

The buffer unit 330 may be a bumper 330*a* mounted on the adjusting bolt 320*a*. In order to firmly connect the bumper 330*a* to the adjusting bolt 320*a*, the bumper 330*a* may be formed so as to surround one end of the adjusting bolt 320*a*.

When the gap between the main body 100 and the first door 200 is determined by moving the adjusting unit 320 toward the fixing unit 310, the gap needs to be maintained. When the first door 200 is repeatedly opened and closed, impact is applied to the adjusting unit 320 and thus a position of the adjusting unit 320 may be changed. Therefore, the gap adjuster 300 includes the position fixing unit 340 to fix the position of the adjusting unit 320.

The position fixing unit 340 may be a locking nut 340*a* having a shape corresponding to the adjusting bolt 320*a* and connected to the adjusting bolt 320*a*. The adjusting bolt 320*a* is first connected to the locking nut 340*a* and is then connected to the fixing nut 310*a*. If the locking nut 340*a* is closely adhered to the fixing nut 310*a*, when the adjusting bolt 320*a* moves toward the fixing nut 310*a*, the adjusting bolt 320*a* receives force in the reverse direction from the locking nut 340*a*. Therefore, movement of the adjusting bolt 320*a* toward the fixing nut 310*a* is restricted by force transmitted from the main body 100 to the fixing nut 310*a* when the first door 200 is closed.

The gap adjuster 300 may be mounted on the main body 100. In this case, the gap adjuster 300 is fixed to the main body 100 and contacts the rear surface of the first door 200 in the closed state of the first door 200. In this case, the fixing unit 310 is mounted on the main body 100.

Figure 3B:
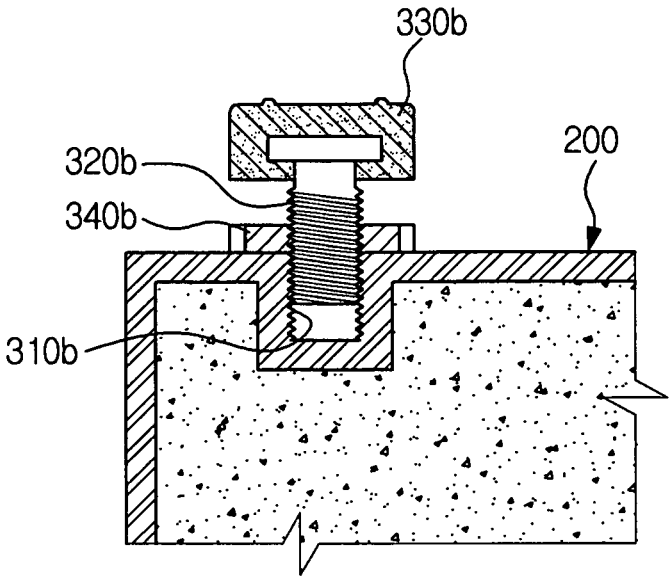
FIG. 3B is a cross-sectional view of a gap adjuster in accordance with another embodiment of the present disclosure.

FIG. 3B is a cross-sectional view of a gap adjuster in accordance with another embodiment of the present disclosure.

As shown in FIGS. 2 and 3B, the adjusting unit 320 may be an adjusting bolt 320*b*, the buffer unit 330 may be a bumper 330*b*, and the position fixing unit 340 may be a locking nut 340*b*. The adjusting bolt 320*b*, the bumper 330*b* and the locking nut 340*b* are the same as the adjusting bolt 320*a*, the bumper 330*a* and the locking nut 340*a* shown in FIG. 3A.

The fixing unit 310 may be a connection hole 310*b* depressed on the rear surface of the first door 200 and provided with a screw thread corresponding to the fixing bolt 320*b* on the inner wall of the connection hole 310*b*. The adjusting bolt 320*b* is turned along the screw thread of the connection hole 310*b*, thus moving forward and backward. The gap between the first door 200 and the main body 100 may be determined by a length of a portion of the adjusting bolt 320*b* protruded to the outside of the connection hole 310*b*.

If the locking nut 340*b* is closely adhered to the outer circumference of the connection hole 310*b*, when the adjusting bolt 320*b* moves toward the fixing nut 310*b*, the adjusting bolt 320*b* receives force in the reverse direction from the locking nut 340*b*. Therefore, arbitrary movement of the adjusting bolt 320*b* toward the connection hole 310*b* when the first door 200 is closed is restricted by the locking nut 340*b*.

Figure 3C:
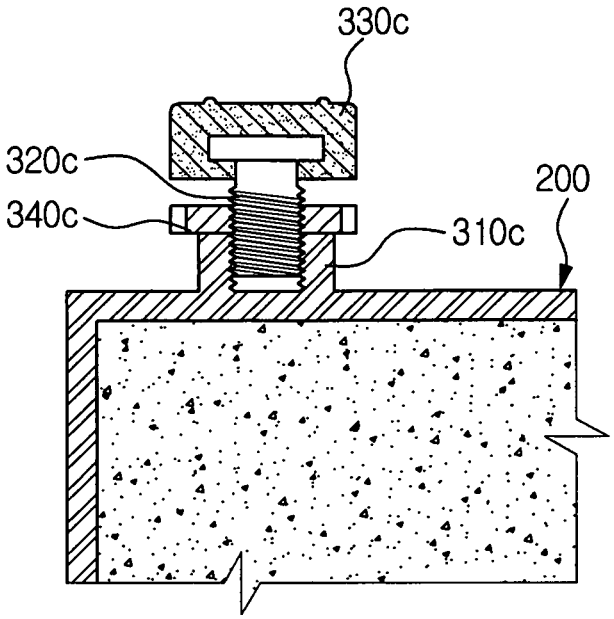
FIG. 3C is a cross-sectional view of a gap adjuster in accordance with another embodiment of the present disclosure.

FIG. 3C is a cross-sectional view of a gap adjuster in accordance with another embodiment of the present disclosure.

As shown in FIGS. 2 and 3C, the adjusting unit 320 may be an adjusting bolt 320*c*, the buffer unit 330 may be a bumper 330*c*, and the position fixing unit 340 may be a locking nut 340*c*. The adjusting bolt 320*c*, the bumper 330*c* and the locking nut 340*c* are the same as the adjusting bolt 320*a*, the bumper 330*a* and the locking nut 340*a* shown in FIG. 3A.

The fixing unit 310 may be a connection protrusion 310*c* protruded from the rear surface of the first door 200. A connection hole is formed through the central portion of the connection protrusion 310*c* and provided with a screw thread corresponding to the fixing bolt 320*c* on the inner wall of the connection hole. The adjusting bolt 320*c* is turned along the screw thread of the connection hole, thus moving forward and backward. The gap between the first door 200 and the main body 100 may be determined by a length of a portion of the adjusting bolt 320*c* protruded to the outside of the connection protrusion 310*c*.

If the locking nut 340*c* is closely adhered to the outer circumference of the connection protrusion 310*c*, when the adjusting bolt 320*c* moves toward the fixing nut 310*c*, the adjusting bolt 320*c* receives force in the reverse direction from the locking nut 340*c*. Therefore, arbitrary movement of the adjusting bolt 320*c* toward the connection protrusion 310*c* when the first door 200 is closed is restricted by the locking nut 340*c*.

Figure 3D:
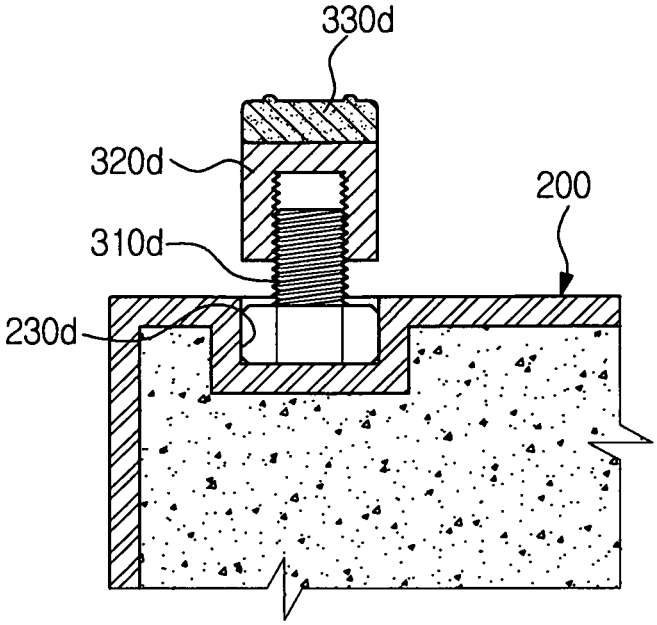
FIG. 3D is a cross-sectional view of a gap adjuster in accordance with another embodiment, of the present disclosure.

FIG. 3D is a cross-sectional view of a gap adjuster in accordance with another embodiment of the present disclosure.

As shown in FIGS. 2 and 3D, the fixing unit 310 may be a fixing bolt 310*d*, the adjusting unit 320 may be an adjusting nut 320*d*, and the buffer unit 330 may be a bumper 330*d*. The fixing bolt 310*d*, the adjusting nut 320*d* and the bumper 330*d* correspond to the fixing nut 310*a*, the adjusting bolt 320*a* and the bumper 330*a* shown in FIG. 3A.

The fixing bolt 310*d* is mounted in a connection hole 230*d* such that a head part of the fixing bolt 310*d* is fixed to the connection hole 230*d* formed on the rear surface of the first door 200 and having a shape corresponding to the head part of the fixing bolt 310*d* and a screw thread part of the fixing bolt 310*d* is protruded to the outside of the rear surface of the first door 200. In order to restrict movement of the fixing bolt 310*d* mounted in the connection hole 230*d*, the head part of the fixing bolt 310*d* is connected to the connection hole 230*d* in an interference fit fashion.

Further, the connection hole 230*d* may be formed by connecting the head part of the fixing bolt 310*d* to the rear surface of the first door 200 through thermocompression. Here, the rear surface of the first door 200 may be made of a polymer which is deformable by heat and pressure.

The adjusting nut 320*d* is turned along the screw thread of the fixing bolt 310*d*, thus moving forward and backward. Thus, the gap between the first door 200 and the main body 100 may be adjusted.

Figure 3E:
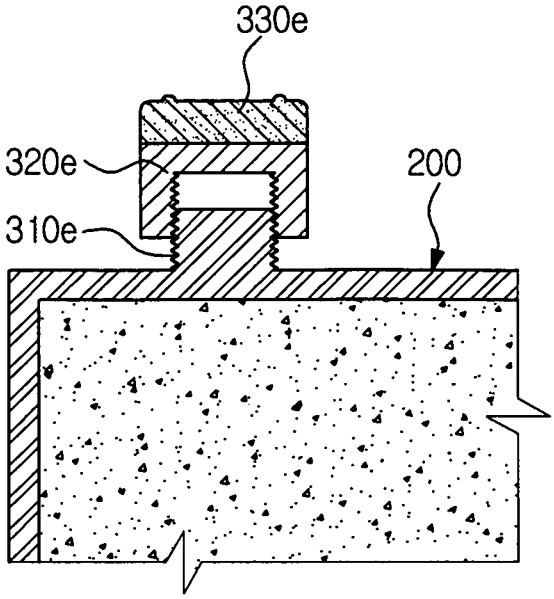
FIG. 3E is a cross-sectional view of a gap adjuster in accordance with another embodiment of the present disclosure.

FIG. 3E is a cross-sectional view of a gap adjuster in accordance with another embodiment of the present disclosure.

As shown in FIGS. 2 and 3E, the adjusting unit 320 may be an adjusting nut 320*e* and the buffer unit 330 may be a bumper 330*e*. The adjusting nut 320*e* and the bumper 330*e* are the same as the adjusting nut 320*d* and the bumper 330*d* shown in FIG. 3D.

The fixing unit 310 may be a connection protrusion 310*e* protruded from the rear surface of the first door 200. A screw thread corresponding to the adjusting nut 320*e* is formed on the outer wall of the connection protrusion 310*e*. The adjusting nut 320*e* is turned along the screw thread of the connection protrusion 310*e*, thus moving forward and backward.

The gap between the first door 200 and the main body 100 may be adjusted by turning the adjusting nut 320*e* along the screw thread of the connection protrusion 310*e*.

Figure 3F:
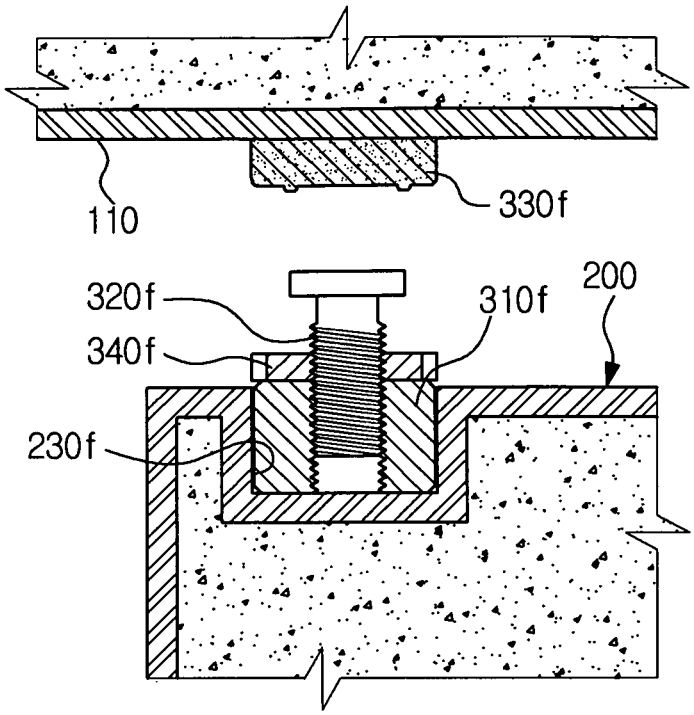
FIG. 3F is a cross-sectional view of a gap adjuster in accordance with another embodiment of the present disclosure.

FIG. 3F is a cross-sectional view of a gap adjuster in accordance with another embodiment of the present disclosure.

As shown in FIGS. 2 and 3F, the fixing unit 310 may be a fixing nut 310*f*, the adjusting unit 320 may be an adjusting bolt 320*d*, and the position fixing unit 340 may be a locking nut 340*f*. The fixing nut 310*f*, the adjusting bolt 320*f* and the locking nut 330*f* are the same as the fixing nut 310*a*, the adjusting bolt 320*a* and the locking nut 340*a* shown in FIG. 3A.

The buffer unit 330 may be a bumper 330*f* fixed to the main body 100. When the first door 200 is closed, the adjusting bolt 320*f* contacts the bumper 330*f*. Therefore, the bumper 330*f* absorbs impact applied to the main body 100 by the adjusting bolt 320*f*.

Figure 4A:
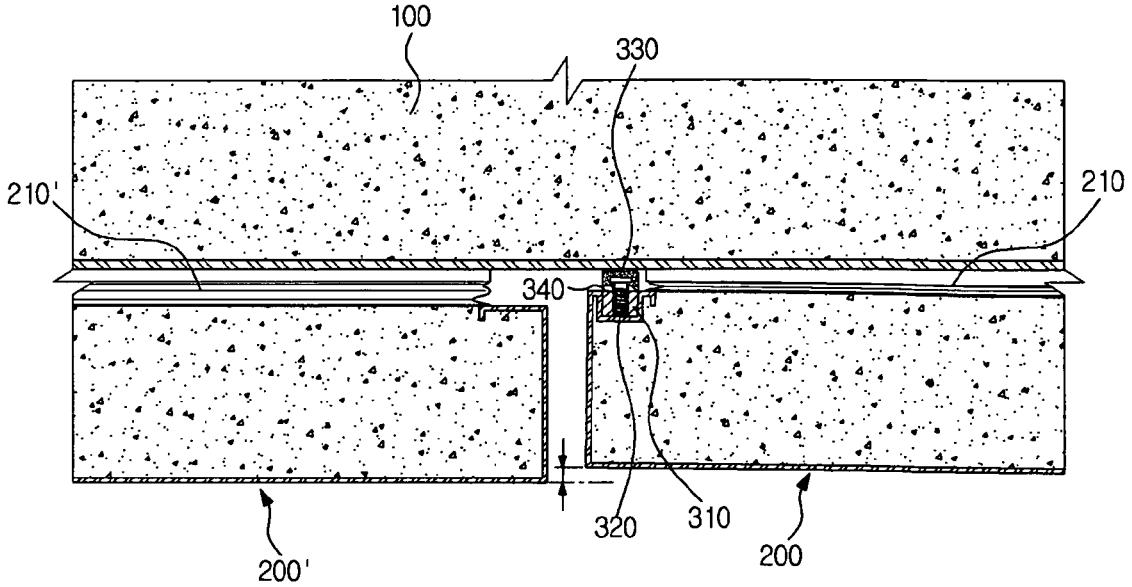
FIGS. 4A and 4B views illustrating operation of a gap adjuster in accordance with one embodiment of the present disclosure.
Figure 4B:
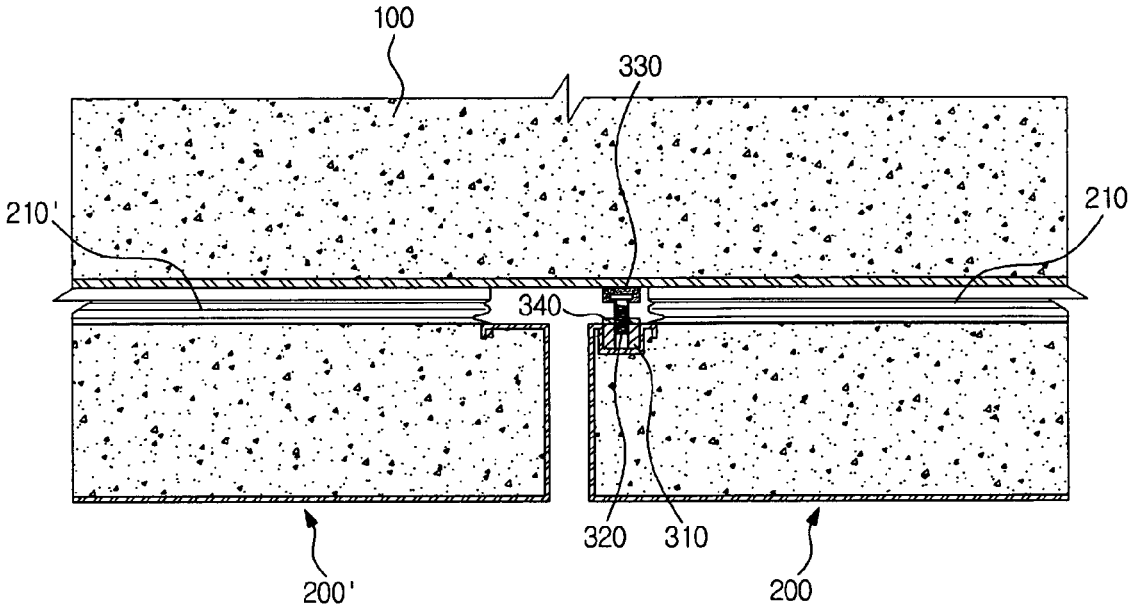

FIGS. 4A and 4B are views illustrating operation of a gap adjuster in accordance with one embodiment of the present disclosure.

As shown in FIG. 4A, a gap between the first door 200 and the main body 100 and a gap between the second door 200' and the main body 100 are different, and thus a step difference between the first door 200 and the second door 200' is generated. The step difference may be generated due to deformation of the doors 200 and 200' during manufacture or assembly. Further, the step difference may be generated due to a magnetic field difference between the gaskets 210 respectively mounted on the first door 200 and the second door 200' or deformation of the gaskets 210 caused by use of the gaskets 210 for a long time.

Although FIG. 4B illustrates the gap adjuster 300 as being mounted on the first door 200, the gap adjuster 300 may be mounted on the second door 200' or on both the first door 200 and the second door 200'.

In order to control the step difference between the first door 200 and the second door 200', the gap between the first door 200 and the main body 100 needs to be increased. Therefore, the adjusting unit 320 is moved in a direction of the main body 100. In order to move the adjusting unit 320, a separate tool, such as a driver, may be used. However, a user may move the gap adjuster 320 by hand without any separate tool.

Here, although the adjusting unit 320 is moved in the direction of the main body 100, the gasket 210 needs to maintain a state of being closely adhered to the main body 100.

When the adjusting unit 320 is moved in the direction of the main body 100 so that the gap between the first door 200 and the main body 100 is the same as the gap between the second door 200' and the main body 100, the step difference between the first door 200 and the second door 200' is eliminated.

In order to maintain the gap between the first door 200 and the main body 100, the position fixing unit 340 is manipulated so as to prevent arbitrary movement of the adjusting unit 320. In one embodiment of the present disclosure shown in FIG. 3A, the position of the adjusting bolt 320*a* is fixed by closely adhering the locking nut 340*a* to the fixing nut 310*a*.

As described above, the gap adjuster 300 may adjust the gap between the first door 200 and the main body 100 by increasing or decreasing the length of the gap adjuster 300 in the forward and backward direction of the first door 200. Although the length of the gap adjuster 300 is increased or decreased, the gasket 210 needs to shield a space between the first door 200 and the main body 100, thereby preventing cool air from leaking to the outside. Therefore, the minimum and maximum lengths of the gap adjuster 300 may be determined by a range of the gasket 300 to maintain the state of being closely adhered to the main body 100 by means of magnetic force although the gasket 210 contracts or expands.

Figure 5:
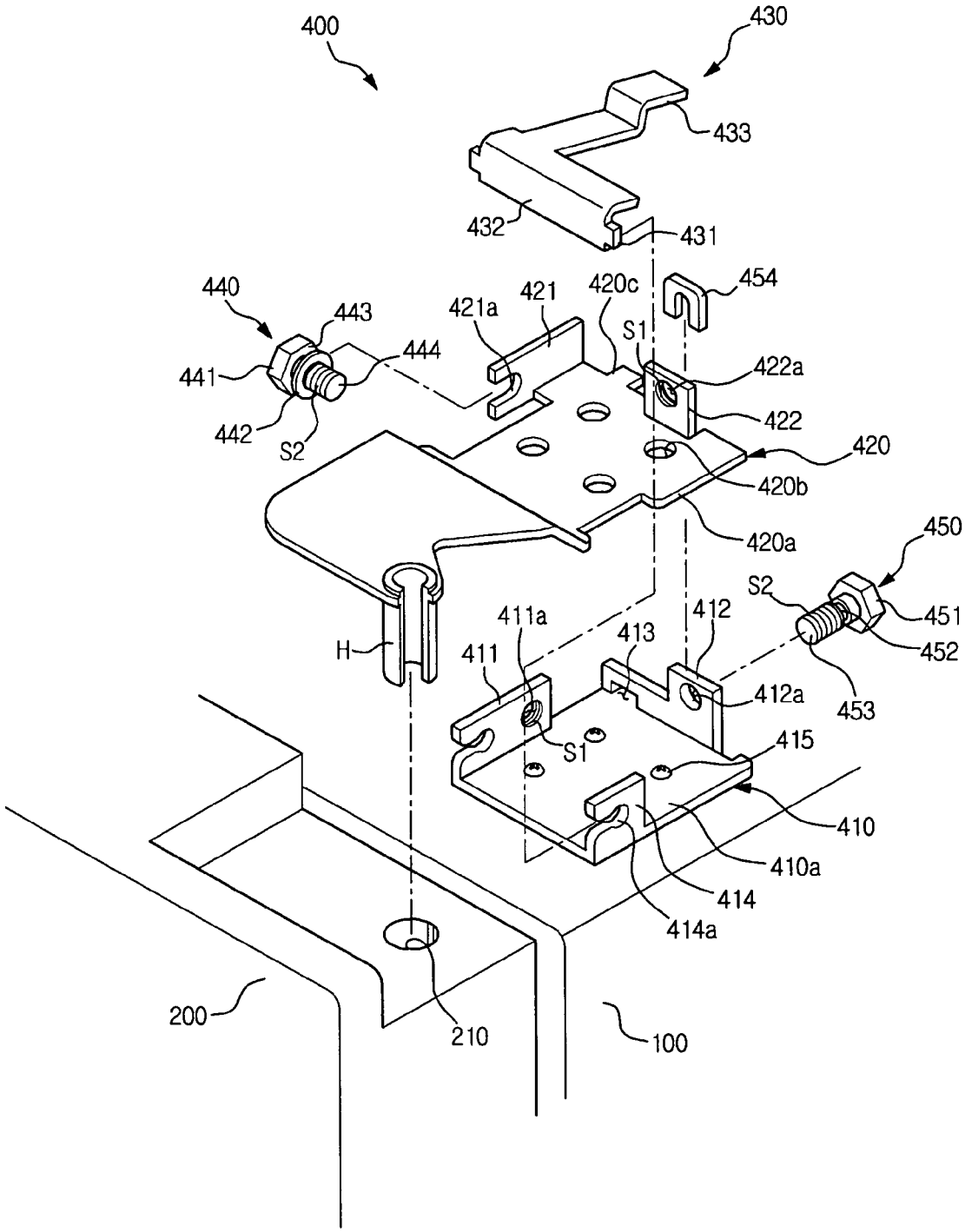
FIG. 5 is an exploded perspective view of a hinge device in accordance with another embodiment of the present disclosure.
Figure 6:
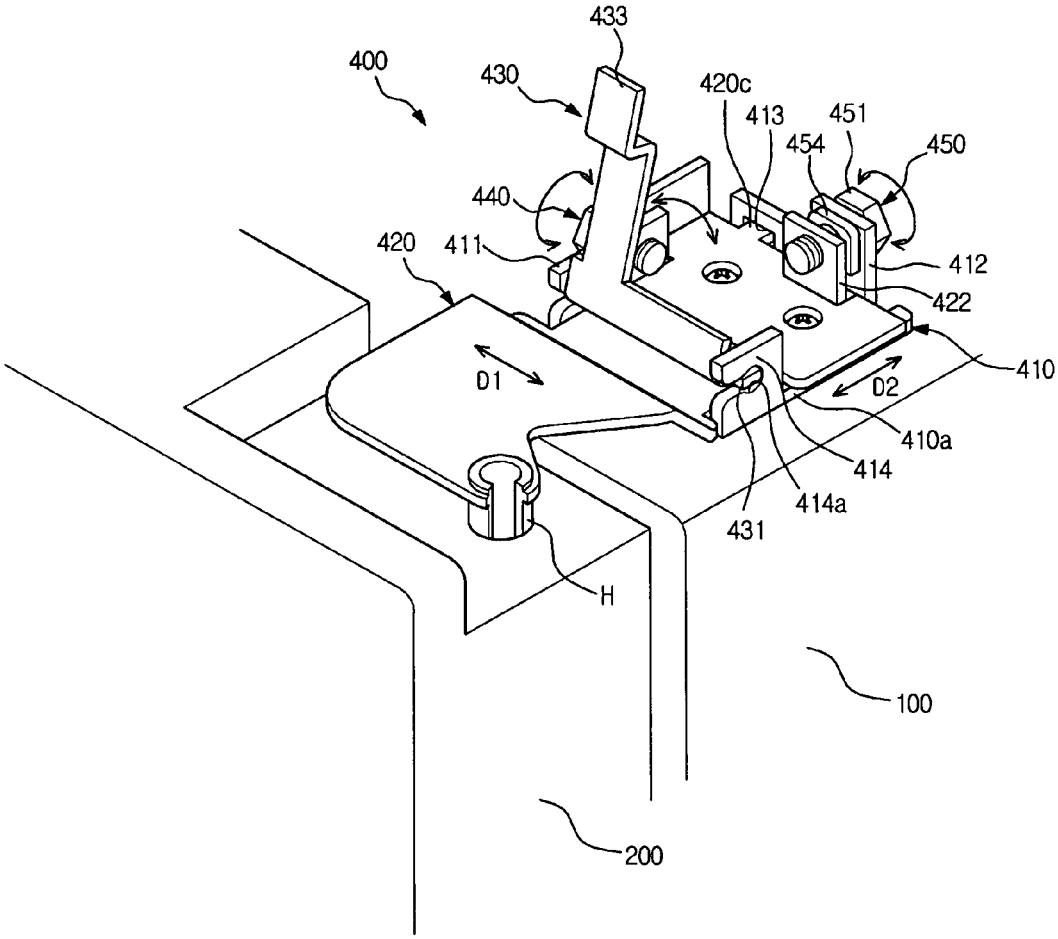
FIG. 6 is a perspective view of the hinge device in an assembled state in accordance with the embodiment of the present disclosure.

FIG. 5 is an exploded perspective view of a hinge device in accordance with another embodiment of the present disclosure and FIG. 6 is a perspective view of the hinge device in an assembled state in accordance with the embodiment of the present disclosure. A hinge device 400 in accordance with this embodiment may be mounted on at least one of the first door 200 and the second door 200'. Hereinafter, the hinge device 400 mounted on the first door 200 will be described.

As shown in FIGS. 5 and 6, the hinge device 400 includes a loading unit 410 fixed to the main body 100, a hinge unit 420 connected to the first door 200 and the loading unit 410, an adjusting unit 440 and 450 to move the hinge unit 420 to adjust a gap between the first door 200 and the main body 100, and a fixing unit 430 to press the hinge unit 420 to closely adhere the hinge unit 420 to the main body 100. Although FIGS. 5 and 6 illustrate the hinge device 400 as being installed on the upper end of the first door 200, the hinge device 400 may be installed also on the lower end of the first door 200.

The loading unit 410 is fixed to the upper surface of the main body 100 so as to allow the hinge unit 420 to move in a first direction D1 and/or a second direction D2. The loading unit 410 includes a plate part 410*a* provided with a plurality of coupling holes (not shown) through which the screws 415 pass.

A first fixing part 411 bent upward is formed at the edge of one side of the plate part 410*a*. A first through hole 411*a* provided with an internal screw thread S1 is formed through the first fixing part 411. Further, a second fixing part 412 bent upward is formed at the edge of the rear end of the plate part 410*a*. In the same manner as the first fixing part 411, a second through hole 412*a* is formed through the second fixing part 412. The second fixing part 412 is provided with an insertion hole 413 formed in the longitudinal direction.

A plurality of screw coupling holes (not shown) are formed on the upper surface of the main body 100 at positions corresponding to the coupling holes of the loading unit 410, and thus the loading unit 410 is fixed to the main body 100 by inserting the screws 415 into the screw coupling holes and the coupling holes. Therefore, the loading unit 410 allows the first door 200 to be rotated in one direction while maintaining connection relations between the hinge unit 420 fixed to the door 200 and the main body 100. Side panels 414 having a designated height are provided at both ends of the plate part 410*a*. The side panels 414 may be formed integrally with the plate part 410*a*, and connection grooves 414*a* into which the fixing unit 430, which will be described later, is inserted are formed on the side panels 414.

The hinge unit 420 to connect the upper end of the first door 200 to the front surface of the main body 100 is provided above the loading unit 410. The hinge unit 420 includes a base part 420*a* adhered to the loading unit 410. The base part 420*a* has a platy shape, is provided with a hinge shaft H formed integrally with one side of the base part 420*a*, and is connected to the first door 200.

A first bent part 421, which is bent upward, is provided at one side of the hinge unit 420 at a position corresponding to the first fixing part 411. The first bent part 421 is extended upward at an angle of about 90 degrees with the base part 420*a*. Further, a first connection part 421*a* recessed to a designated length is provided at one end of the first bent part 421.

A second bent part 422, which is bent upward, is provided at the rear end of the hinge unit 420 at a position corresponding to the second fixing part 412. In the same manner as the first bent part 421, the second bent part 422 is extended upward at an angle of about 90 degrees with respect to the base part 420*a*. Further, a second connection part 422*a* provided with the first internal thread S1 is provided on the second bent part 422.

Further, an insertion protrusion 420*c* is provided on the hinge unit 420 at a position corresponding to the insertion hole 413 formed on the second fixing part 412 of the loading unit 410. By inserting the insertion protrusion 420*c* of the hinge unit 420 into the insertion hole 413, the hinge unit 420 is more stably connected to the loading unit 410. Screw guide holes 420*b*, through which the screws 415 used to fix the loading unit 410 to the main body 100 and/or to disassemble the loading unit 410 from the main body 100 pass, are provided on the central portion of the base part 420*a*.

The hinge device 400 includes the adjusting unit 440 and 450 to adjust the minute gap between the first door 200 and the main body 100. The adjusting unit 440 and 450 includes a first adjusting screw 440 to adjust movement of the first door 200 in the first direction D1 and a second adjusting screw 450 to adjust movement of the first door 200 in the second direction D2. As seen from the front surface of the refrigerator in the drawings, the first direction represents a leftward and rightward direction and the second direction represents a forward and backward direction. However, the first direction and/or the second direction may represent various directions according installed positions of the hinge device 400 and the adjusting screws 440 and 450.

The first adjusting screw 440 is provided so as to connect the first fixing part 411 formed on the loading unit 410 and the first bent part 421 formed on the hinge unit 420 corresponding to the first fixing part 411.

The first adjusting screw 440 includes a head part 441 at the external portion of the screw 440 and a fixing washer part 442, the position of which is fixed, formed at a portion of the screw 440 extended inward from the head part 441. The first adjusting screw 440 further includes a fixing gap part 443 having a regular gap and provided between the head part 441 and the fixing washer part 442. Here, the head part 441 may be deformed so as to be suitable to various tools, and the fixing gap part 443 is inserted into the first connection part 421*a* of the first bent part 421. The fixing gap part 443 may be configured such that the gap of the fixing gap part 443 is varied according to the thickness of the first connection part 421*a*.

A screw thread part 444 is provided on the outer circumferential surface of a cylindrical portion of the first adjusting screw 440 passing through the fixing washer part 442 and extended inward from the head part 441. An external screw thread S2 extended in one direction is formed on the screw thread part 444, and the screw thread part 444 may move in the first direction D1 along the internal screw S1 formed in the first through hole 411*a* of the first fixing part 411.

The second adjusting screw 450 is provided so as to connect the first fixing part 412 formed at the rear end of the loading unit 410 and the second bent part 422 formed at the rear end of the hinge unit 420 corresponding to the second fixing part 412. Further, a washer member 454 to turn the second adjusting screw 450 in place is provided between the second fixing part 412 and the second bent part 422.

The second adjusting screw 450 includes a head part 451 at the external portion of the screw 450 and a washer insertion groove 452 formed at a portion of the screw 450 extended inward from the head part 451. A screw thread part 453 is provided on the outer circumferential surface of a cylindrical portion of the second adjusting screw 450 extended inward from the head part 451. An external screw thread S2 extended in one direction is formed on the screw thread part 453, and the screw thread part 453 may be turned in place along the internal screw S1 formed on the second connection part 422*a* without forward and backward movement. Therefore, the second bent part 422 of the hinge unit 420 may move in the second direction D2 according to turning of the second adjusting screw 450.

The fixing unit 430 to press the hinge unit 420 to closely adhere the hinge unit 420 to the main body 100 is provided above the hinge unit 420. The fixing unit 430 includes a connection shaft 431 rotatably connected to the loading unit 410. Both ends of the connection shaft 431 are respectively connected to the connection grooves 414*a* formed at both ends of the loading unit 410, thus allowing the connection shaft 431 to be rotated. The fixing unit 430 includes a pressure part 432 to press the hinge unit 420 to closely adhere the hinge unit 420 to the main body 100 when the connection shaft 431 is rotated, and a handle part 433 extended from the pressure part 432 in the longitudinal direction. Therefore, when the handle part 433 is rotated at a designated angle under the condition that the connection shaft 431 is connected to the connection grooves 414*a*, the base part 420*a* of the hinge unit 420 presses the plate part 410*a* of the loading unit 420 in a direction of the upper surface of the main body 100. Those skilled in the art will appreciate that the fixing unit 430 may have any shape allowing the base part 420*a* to be closely adhered to the loading unit 410 without a clearance.

Hereinafter, operation of the above hinge device 400 will be described.

Figure 7:
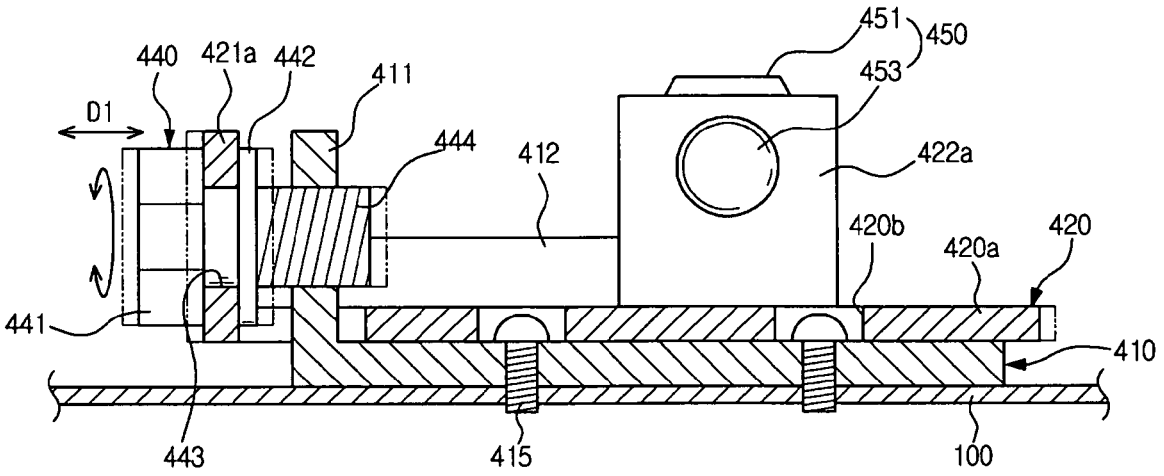
FIG. 7 is a view illustrating operation of a first adjusting screw in accordance with the embodiment of the present disclosure.

FIG. 7 is a view illustrating a process of moving the hinge unit in the first direction through the first adjusting screw.

As shown in FIG. 7, when the first adjusting screw 440 is rotated in the clockwise direction or in the counterclockwise direction, the first adjusting screw 440 is movable along the first fixing part 411 fixed to the main body 100. Then, the first connection part 421*a* connected to the fixing gap part 443 of the first adjusting screw 440 moves in the first direction D1 according to movement of the first adjusting screw 440. Therefore, the hinge unit 420 integrated with the first connection part 421*a* moves in the first direction D1. Accordingly, the gap between the first door 200 and the main body 100 of the refrigerator is adjusted by moving the hinge unit 420.

Figure 8:
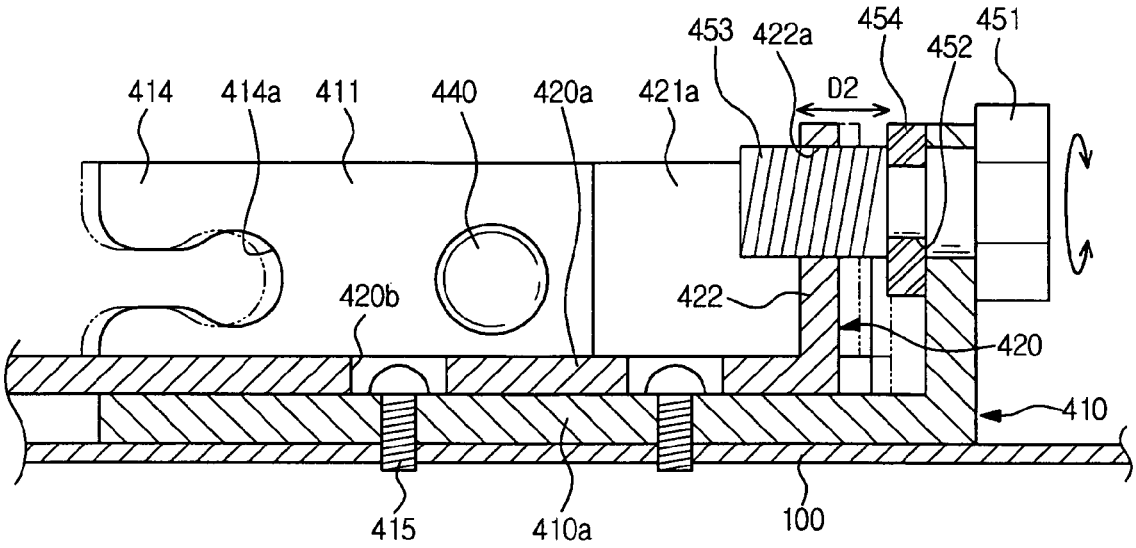
FIG. 8 is a view illustrating operation of a second adjusting screw in accordance with the embodiment of the present disclosure.

FIG. 8 is a view illustrating a process of moving the hinge unit in the second direction through the second adjusting screw.

As shown in FIG. 8, when the second adjusting screw 450 is rotated in the clockwise direction or in the counterclockwise direction, the second adjusting screw 450 is turned in place along the second fixing part 412 fixed to the main body 100. That is, when the head part 451 is rotated under the condition that the washer member 454 is assembled with the inside of the washer insertion groove 452 of the second adjusting screw 450, the second adjusting screw 450 does not move in the forward and backward direction but is turned in place. Then, the hinge unit 420 moves in the second direction D2 along the internal screw thread S1 of the second connection part 422*a* and the external screw thread S2 of the second adjusting screw 450. Therefore, the hinge unit 420 integrated with the second connection part 421*a* moves in the second direction D2. Accordingly, the gap between the first door 200 and the main body 100 of the refrigerator is adjusted by moving the hinge unit 420 forward and backward.

That is, the gap between the first door 200 and the main body 100 is minutely adjusted by rotating the above-described first adjusting screw 440 and/or second adjusting screw 450, and the position of the first door 200 in the leftward and rightward direction and in the forward and backward direction is adjusted through such adjustment of the gap.

As is apparent from the above description, in a refrigerator in accordance with one embodiment of the present disclosure, a step difference between refrigerator doors is compensated for by adjusting gaps between the refrigerator doors and a main body, thereby providing a fine external appearance of a front surface of the refrigerator.

Further, although a step difference between the refrigerator doors occurs during use of the refrigerator, a user may easily compensate for the step difference without any separate tool.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. A refrigerator comprising:

a main body provided with a first storage chamber and a second storage chamber disposed at one side of the first storage chamber;

a first door connected to the main body so as to open and close the first storage chamber;

a second door connected to the main body so as to open and close the second storage chamber;

a hinge device installed at one side of the first door; and a gap adjuster installed on a rear surface of an other side of the first door such that a length of the gap adjuster is increased or decreased so as to adjust a gap between the main body and the first door, wherein the gap adjuster adjusts a step difference in a forward and backward direction between the first door and the second door in a state that a buffer unit of the gap adjuster makes contact with the front surface of the main body when the first door is closed while the length of the gap adjuster is increased or decreased.

2. The refrigerator according to claim 1, wherein the gap adjuster includes:

a connection hole formed on the at least one door;

a fixing nut mounted in the connection hole in an interference fit fashion; and an adjusting bolt rotatably connected to the fixing nut, wherein the buffer unit is disposed between the adjusting bolt and the main body to damp impact applied to the main body by the adjusting bolt.

3. The refrigerator according to claim 2, wherein the buffer unit is made of an elastic material and is connected to the adjusting bolt.

4. The refrigerator according to claim 2, wherein the gap adjuster further includes a position fixing unit to fix a position of the adjusting bolt.

5. A refrigerator comprising:

a main body provided with a first storage chamber and a second storage chamber disposed at one side of the first storage chamber;

a first door connected to the main body so as to open and close the first storage chamber;

a second door connected to the main body so as to open and close the second storage chamber;

a hinge device installed between the main body and one side of the first door to hinge the first door; and a gap adjuster installed on a rear surface of an other side of the first door such that a length of the gap adjuster is increased or decreased, wherein the gap adjuster adjusts a step difference in a forward and backward direction between the first door and the second door in a state that a buffer unit of the gap adjuster makes contact with the front surface of the main body when the first door is closed while the length of the gap adjuster is increased or decreased.

6. The refrigerator according to claim 5, wherein the gap adjuster contacts an upper end of the front surface of the main body in a closed state of the first door.

7. The refrigerator according to claim 5, wherein the gap adjuster includes:

a connection hole formed on the at least one door;

a fixing nut mounted in the connection hole in an interference fit fashion; and an adjusting bolt rotatablv connected to the fixing nut, wherein the fixing nut is fixed to the first door through thermocompression.

8. The refrigerator according to claim 5, wherein the gap adjuster includes:

a connection hole formed on the at least one door;

a fixing nut mounted in the connection hole in an interference fit fashion;

an adjusting bolt rotatably connected to the fixing nut;

a position fixing unit to fix a position of the adjusting bolt;

wherein the position fixing unit includes a locking nut connected to the adjusting bolt, and the locking nut is closely adhered to the fixing nut so as to prevent arbitrary movement of the adjusting bolt in a direction of the fixing nut.

* * * * *

UNITED STATES PATENT AND TRADEMARK OFFICE

CERTIFICATE OF CORRECTION

PATENT NO. : 8,894,168 B2
APPLICATION NO. : 13/067898
DATED : November 25, 2014
INVENTOR(S) : Jin Sik Lee It is certified that error appears in the above-identified patent and that said Letters Patent is hereby corrected as shown below:

In the Claims

Column 13, Line 15, In Claim 7, delete “rotatablv” and insert -- rotatably --.

Signed and Sealed this
Second Day of June, 2015

Michelle K. Lee

Michelle K. Lee
*Director of the United States Patent and Trademark Office*